US006029413A

United States Patent [19]

Compas, Jr.

[11] Patent Number: 6,029,413

[45] Date of Patent: Feb. 29, 2000

[54] DROPPED CEILING SUPPORT FRAME

[76] Inventor: Albert W. Compas, Jr., 3900 Shipman Cutoff Rd., Bunker Hill, Ill. 62014

[21] Appl. No.: 09/172,574

[22] Filed: Oct. 14, 1998

[51] Int. Cl.[7] ..... E04B 9/18

[52] U.S. Cl. ..... 52/506.06; 52/506.07; 52/664; 52/DIG. 8

[58] Field of Search ..... 52/506.06, 506.07, 52/664, DIG. 8

[56] References Cited

U.S. PATENT DOCUMENTS

| | | | |
|---|---|---|---|
| 3,084,401 | 4/1963 | Findlay | 52/506.07 X |
| 3,119,475 | 1/1964 | Adams | 52/506.07 X |
| 3,352,071 | 11/1967 | Sutter | 52/506.07 X |
| 4,019,300 | 4/1977 | Sauer et al. | 52/506.06 X |
| 4,047,348 | 9/1977 | McSweeney | 52/506.06 |
| 4,827,687 | 5/1989 | Frawley | 52/506.06 |
| 5,077,951 | 1/1992 | Baker . | |
| 5,115,611 | 5/1992 | Lim et al. . | |
| 5,239,801 | 8/1993 | Adams . | |
| 5,265,393 | 11/1993 | Bischel et al. . | |
| 5,390,456 | 2/1995 | Platt et al. . | |

*Primary Examiner*—Carl D. Friedman
*Assistant Examiner*—Phi A Tran
*Attorney, Agent, or Firm*—Koley, Jessen, Daubman & Rupiper, P.C.; Mark D. Frederiksen

[57] ABSTRACT

A support frame for a dropped ceiling includes a plurality of elongated primary rails disposed substantially parallel to one another, with a plurality of elongated secondary rails disposed parallel to one another and transversely between a pair of primary rails to form a grid system. A ceiling panel is positioned with its edges supported on a pair of primary and secondary rails to form the dropped ceiling. Each primary rail includes an elongated generally inverted U-shaped support member connected to an upper face thereof to support and suspend the primary rails. Each secondary rail includes an elongated ridge with projecting ends connected to the primary rail support member to support the secondary rail from the primary rail support members. An insert extends the length of the primary rail and has a lower edge slidably engaged in a slot in the primary rail upper face, to support the primary rail therefrom. The insert is journaled between the legs of the primary rail support member and secured with fasteners.

15 Claims, 4 Drawing Sheets

DROPPED CEILING SUPPORT FRAME

TECHNICAL FIELD

The present invention relates generally to a ceiling system, and more particularly to a suspended ceiling system which provides an exposed wood display surface for supporting the ceiling panels.

BACKGROUND OF THE INVENTION

Suspended ceilings are well known, and typically are formed with a grid of support members including longitudinally extending rails and secondary rails extending perpendicularly to the primary rails. Ceiling panels are then placed in the ceiling grid.

The major drawback of conventional suspended ceiling systems is the use of metal strips to divide and support the ceiling panels. While these metal strips provide sufficient support for the ceiling panels, they typically are "sterile" and can be unappealing in appearance. This is particularly the case in an office setting, wherein the room is furnished with wood products, and the ceiling system is of a contrasting metal construction.

SUMMARY OF THE INVENTION

It is therefore a general object of the present invention to provide an improved dropped ceiling support frame with exposed wood members for supporting the ceiling panels.

Another object is to provide a dropped ceiling support frame which is easily adjustable to accept various sizes of ceiling panels.

A further object of the present invention is to provide a dropped ceiling support frame which is economical to manufacture and refined in appearance.

These and other objects of the present invention will be apparent to those skilled in the art.

The support frame for a dropped ceiling of the present invention includes a plurality of elongated primary rails disposed substantially parallel to one another, with a plurality of elongated secondary rails disposed parallel to one another and transversely between a pair of primary rails to form a grid system. A ceiling panel is positioned with its edges supported on a pair of primary and secondary rails to form the dropped ceiling. Each primary rail includes an elongated generally inverted U-shaped support member connected to an upper face thereof to support and suspend the primary rails. Each secondary rail includes projecting ends connected to the primary rail support member to support the secondary rail from the primary rail support members. An insert extends the length of the primary rail and has a lower edge slidably engaged in a slot in the primary rail upper face, to support the primary rail therefrom. The insert is journaled between the legs of the primary rail support member and secured with fasteners.

DESCRIPTION OF THE PREFERRED EMBODIMENT

Figure 1:
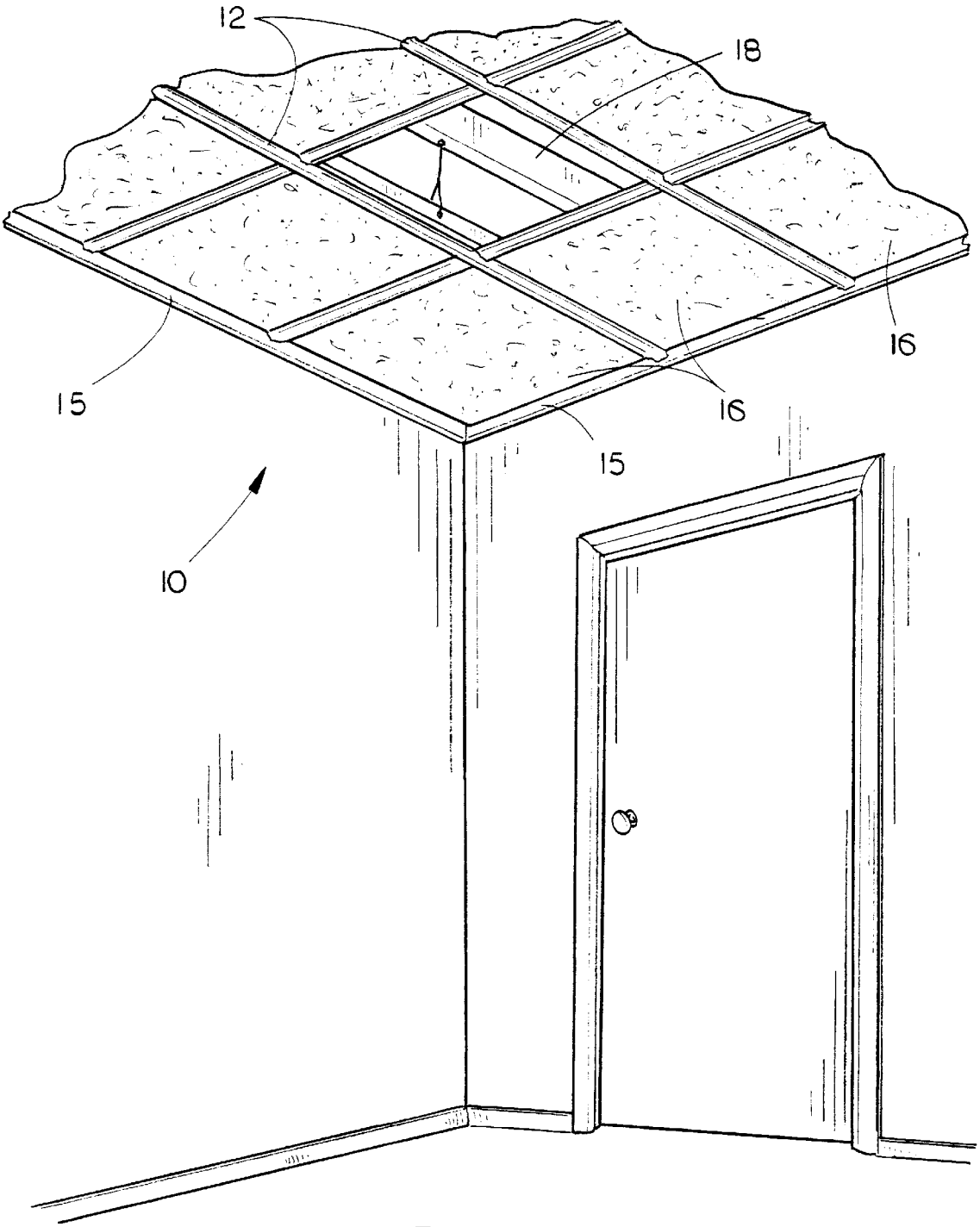
FIG. 1 is a perspective view of a portion of a room with the dropped ceiling support frame of the present invention installed therein.

Referring now to the drawings, in which similar or corresponding parts are identified with the same reference numeral, and more particularly to FIG. 1, the support frame of the present invention is designated generally at 10 and includes a plurality of parallel, longitudinally extending primary rails 12, a plurality of transversely extending secondary rails 14 extending between the primary rails, to form a grid for receiving ceiling panels 16, and a wall-mounted molding 15, for supporting the ends of rails 12 and 14. One ceiling panel is removed in FIG. 1, to show the underlying ceiling girders 18 from which support frame 10 is suspended.

Figure 2:
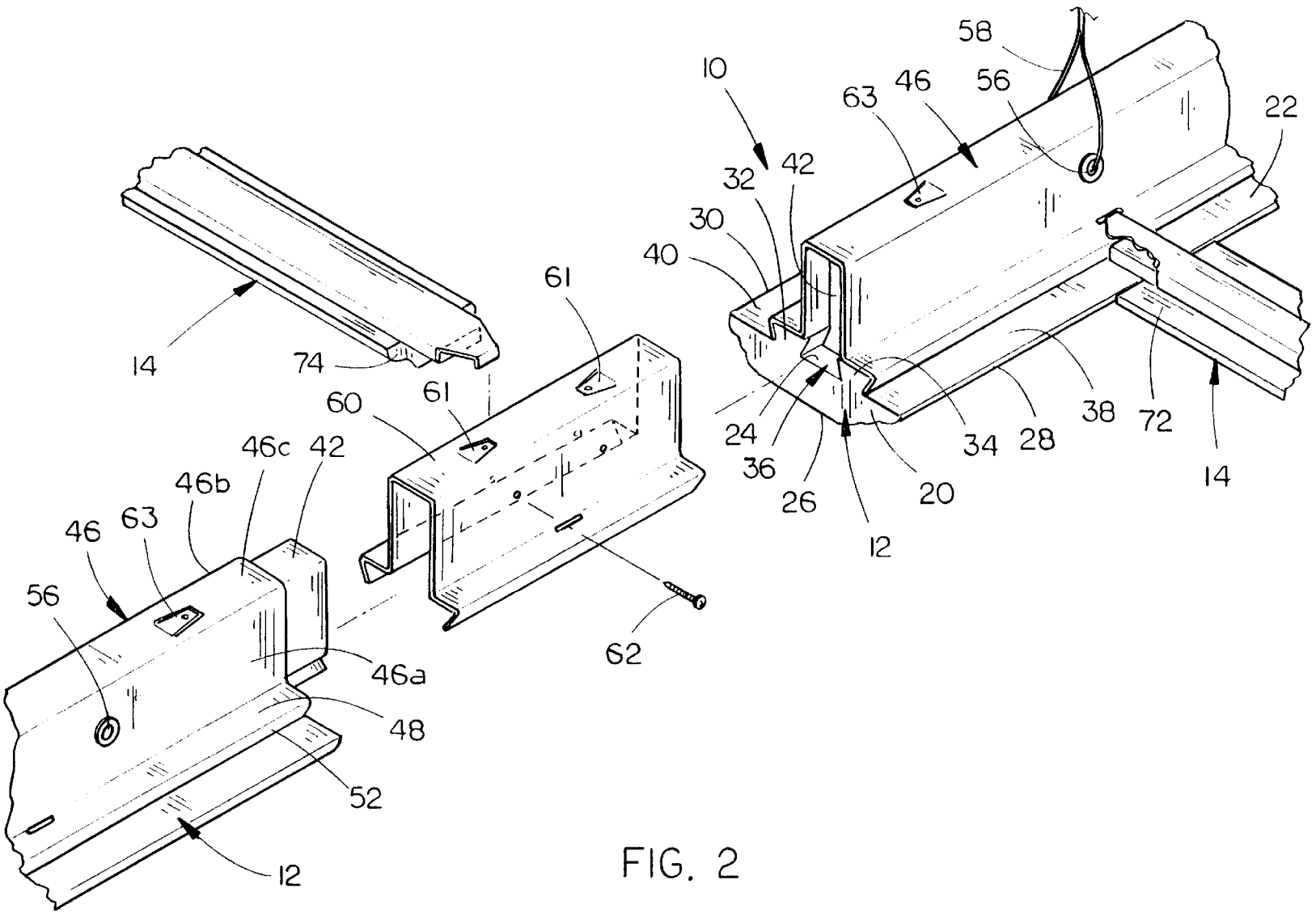
FIG. 2 is an enlarged perspective view of the support frame of the present invention.

Referring now to FIG. 2, it can be seen that primary rail 12 is an elongated member having forward and rearward ends 20 and 22, upper and lower faces 24 and 26, and opposing longitudinal sides 28 and 30 respectively. The upper face 24 of rail 12 includes a pair of longitudinally extending upwardly projecting ridges 32 and 34 extending the length thereof and spaced inwardly from sides 28 and 30. Thus, ridges 32 and 34 form a longitudinally extending slot 36 therebetween, and a pair of support ledges 38 and 40 along each side 28 and 30 on the upper surface 24 of the rail.

The lower face 26 and the surfaces of sides 28 and 30 of primary rail 12 form the exposed wood face of rail 12, which will be viewed once the ceiling panels are in position. Ledges 38 and 40 form one support surface for an edge of a ceiling panel, as shown in more detail in FIG. 3.

Figure 3:
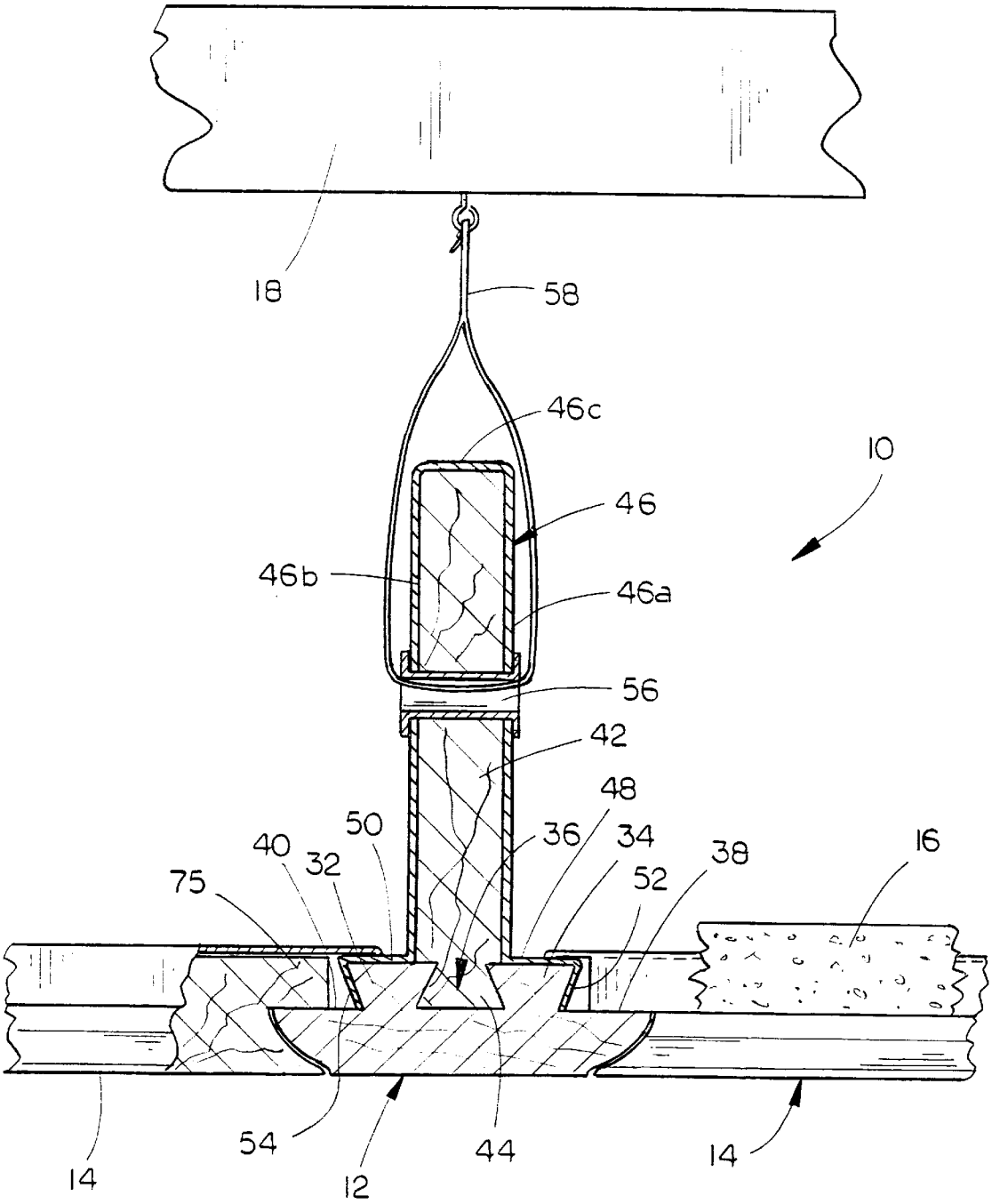
FIG. 3 is an end view of a primary support member suspended from a ceiling and having a pair of secondary support members connected thereto.

As shown in FIG. 3, a generally rectangular wood insert 42 extends the length of primary rail 12, and has a dove tail shaped lower edge 44 which is shaped to slidably engage the dove tail shape slot 36 between ridges 32 and 34. Thus, insert 42 may be slidably inserted with its lower edge engaging slot 36, to support primary rail 12 from the lower edge 44.

As shown in FIGS. 2 and 3, an elongated inverted U-shaped channel 46 includes a pair of parallel legs **46*a* and 46*b* depending from a web 46*c*, and extending the length of rail 12. Channel 46 has a width between legs 46*a* and 46*b* to snugly receive insert 42 therebetween. The lower edge of each leg 46*a* and 46*b* includes an outwardly projecting flange 48 and 50, respectively, extending along their lengths and projecting generally perpendicularly outwardly from legs 46*a* and 46*b*. Each flange 48 and 50 has a downwardly and inwardly directed strip 52 and 54 respectively also extending the length of the channel legs 46*a* and 46*b*. As can be seen in the figures, flanges 48 and 50 contact the top surface of ridges 34 and 32, while strips 52 and 54 engage the outward faces of ridges 34 and 32**, respectively.

A plurality of sleeves 56 are journaled through the legs **46*a* and 46*b* of channel 46 and insert 42, and are spaced uniformly along the length of channel 46. Sleeves 56 serve to connect the channel 46 to insert 42, and to receive cable 58, to support the primary rail 12 from ceiling girder 18**.

As shown in FIG. 2, a connector channel 60 is provided in those situations where more than one length of primary rail 12 must be connected to form an extended length rail. Connector channel 60 has the same shape as channel 46, and has dimensions to slide snugly over each end of channel 46 when the ends of the rail are abutted. Preferably, insert 42 projects from one end of a primary rail 12', and is depressed within the other end of primary rail 12, to form an overlapping connection between primary rails 12 and 12'. A plurality of screws 62 or other fasteners may be threaded through connector channel 60 into channels 46 and inserts 42 to secure the connector channel 60 in position, and thereby provide a rigid connection between the primary rails 12 and 12'. In addition, a pair of depressed tabs 61 on connector channel 60 cooperate with depressions 63 in channels 46 to locate connector channel 60 centered over the connection between primary rails 12 and 12'.

Figure 4:
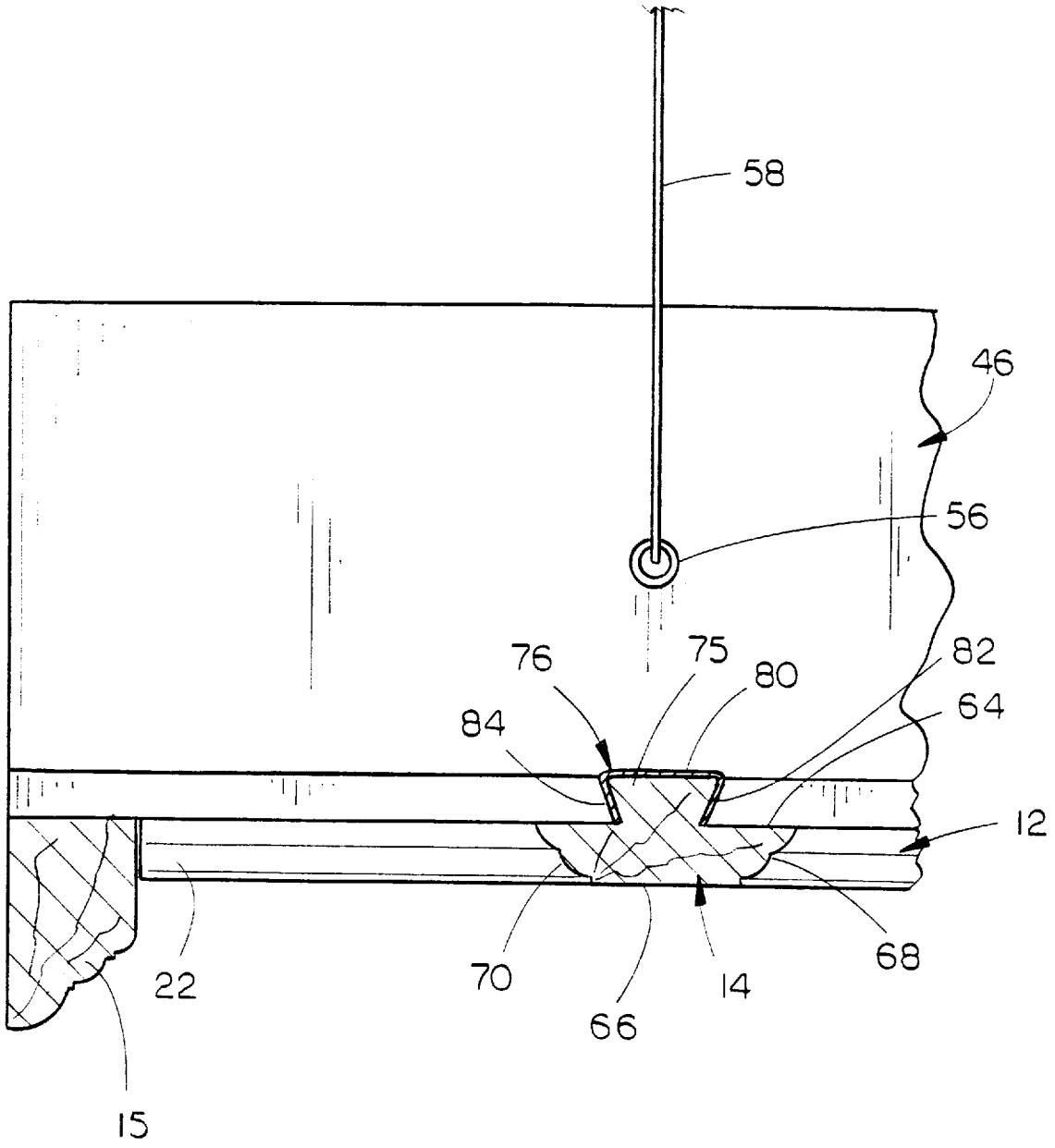
FIG. 4 is a side elevational view taken from the right side of FIG. 3 and additionally showing the support of one end of a primary support member at a wall.

Referring now to FIG. 4, a secondary rail 14 is shown in cross-sectional view, connected to primary rail 12. Secondary rail 14 has the same shape and appearance as the primary rail, including an upperface 64, lowerface 66, longitudinal sides 68 and 70 and opposing first and second ends 72 and 74 (shown in FIG. 2). A ridge 75 projects upwardly from the upper face 64 of secondary rail 14, and extends the length thereof, and projects outwardly from each end, to support secondary rail 14 on ledges 38 and 40. An elongated metal channel 76 is mounted in an inverted condition to the ridge 75 of each secondary rail. Channel 76 includes a web portion 80 and a pair of depending legs 82 and 84. Each channel 76 has opposing ends 86 and 88 as shown in FIG. 2, which may be selectively connected to the flanges 48 or 50 of primary rail channel 46, as described in more detail below.

Referring now to FIGS. 2 and 3, it can be seen that the first and second ends 72 and 74 of secondary rails 14 are cut to match the profile of the sides 28 and 30 of primary rail 12. The ends of ridge 75 project outwardly beyond the ends of the secondary rail, to rest on ledges 38 and 40 of the primary rail 12. A tab 90 is bent downwardly at each end 86 and 88 of channels 76 and will engage a corresponding slot 92 formed in each flange 48 and 50 along the length of primary rail channel 46. Slots 92 are preferably uniformly spaced at standard positions to form a grid pattern when the secondary rail channels 76 are engaged with the slots 92. Thus, the location of the secondary rails 14 may be selectively moved to any slot 92, to provide versatility in the grid pattern formed by support frame 10.

Referring once again to FIG. 4, it can be seen that the rearward end 22 of primary rail 12 is cut shorter than channel 46, and the insert 42 (not shown in FIG. 4) such that channel 46 will be supported directly on molding 15. In this way, molding 15 may be attached to the walls of a room to provide a level support for the ends of the primary rails 12 and secondary rails 14.

Whereas the invention has been shown and described in connection with the preferred embodiment thereof, many modifications, substitutions and additions may be made which are within the intended broad scope of the appended claims.

I claim:

1. A support frame in combination with for a dropped ceiling formed of a plurality of individual ceiling panels, comprising:

a plurality of elongated primary rails disposed substantially parallel to one another and having upper and lower faces, forward and rearward ends, and opposing sides;

a plurality of elongated secondary rails disposed substantially parallel to one another and supported transversely between a pair of primary rails to form a grid system with a plurality of openings, said secondary rails each including opposing first and second ends, upper and lower faces and opposing sides;

at least one ceiling panel having opposite side edges and opposing end edges positioned in an opening, with the end edges supported on a pair of primary rails and the side edges supported on a pair of secondary rails; and each primary rail having an elongated support member removably connected to the upper face thereof and extending the length thereof, for suspending the rail from a ceiling;

said secondary rails have a ridge on the upper face thereof with opposing ends projecting beyond the ends of the secondary rails, the secondary rail ends being removably connected to the primary rail support members to suspend and support the secondary rails.

2. The support frame of claim 1 wherein each primary rail support member includes upper and lower ends, forward and rearward ends, and opposing longitudinal sides, each side having a plurality of uniformly spaced slots formed therein, and wherein each end of each secondary rail includes an elongated locator channel connected to the ridge and having opposing ends projecting beyond the ridge ends, and each channel end including a tab engaged within one of said primary rail support member slots.

3. The support frame of claim 2, wherein the second rail ends have a profile which matches the sides of the primary rail, and wherein the secondary rails are coplanar with and in abutting engagement with the sides of the primary rails.

4. The support frame of claim 3, wherein each said primary rail support member has a generally inverted U-shaped transverse cross-section, with a longitudinally extending wood portion forming the upper end and a pair of depending longitudinally extending legs, forming the sides.

5. The support frame of claim 4, wherein:

said primary rail support member legs include an outwardly projecting, longitudinally extending, flange along the lower ends thereof, with a downwardly projecting, longitudinally extending strip, along outward edges of the flanges; and said primary rail includes a pair of parallel, spaced apart ridges formed in the upper face, each ridge spaced inwardly from the sides of the primary rail to form longitudinally extending ledges on the primary rail upper face between each ridge and its associated side of the primary rail;

said strips on the primary rail support member legs engaging said ridges to support the primary rail.

6. The support frame of claim 5, wherein said primary rail includes a longitudinally extending slot formed in the upper face thereof, extending the length of the rail, and further comprising:

an elongated insert journaled between the legs of the primary rail support member and extending the leg thereof;

said insert having a lower edge slidably engaged in the slot in the primary rail upper face, permitting horizontal slidable movement, but preventing vertical movement of the rail from the insert lower edge; and at least one fastener connecting the insert to the primary rail support member, to support the primary rail on the primary rail support member.

7. The support frame of claim 1, wherein the second rail ends have a profile which matches the sides of the primary rail, and wherein the secondary rails are coplanar with and in abutting engagement with the sides of the primary rails.

8. The support frame of claim 1, wherein each said primary rail support member has a generally inverted U-shaped transverse cross-section, with a longitudinally extending wood portion forming the upper end and a pair of depending longitudinally extending legs, forming the sides.

9. The support frame of claim 8, wherein:

said primary rail support member legs include an outwardly projecting, longitudinally extending, flange along the lower ends thereof, with a downwardly projecting, longitudinally extending strip, along outward edges of the flanges; and said primary rail includes a pair of parallel, spaced apart ridges formed in the upper face, each ridge spaced inwardly from the sides of the primary rail to form longitudinally extending ledges on the primary rail upper face between each ridge and its associated side of the primary rail;

said strips on the primary rail support member legs engaging said ridges to support the primary rail.

10. The support frame of claim 8, wherein said primary rail includes a longitudinally extending slot formed in the upper face thereof, extending the length of the rail, and further comprising:

an elongated insert journaled between the legs of the primary rail support member and extending the leg thereof;

said insert having a lower edge slidably engaged in the slot in the primary rail upper face, permitting horizontal slidable movement, but preventing vertical movement of the rail from the insert lower edge; and at least one fastener connecting the insert to the primary rail support member, to support the primary rail on the primary rail support member.

11. A support frame in combination with a dropped ceiling formed of a plurality of individual ceiling panels, comprising:

a plurality of elongated primary rails disposed substantially parallel to one another and a plurality of elongated secondary rails disposed substantially parallel to one another and supported transversely between a pair of primary rails to form a grid system with a plurality of openings, said secondary rails each including opposing first and second ends, upper and lower faces and opposing sides;

at least one ceiling panel having opposite side edges and opposing end edges positioned in an opening, with the end edges supported on a pair of primary rails and the side edges supported on a pair of secondary rails; and each primary rail having an elongated support member removably connected to the upper face thereof and extending the length thereof, for suspending the rail from a ceiling;

each primary rail support member includes upper and lower ends, forward and rearward ends, and opposing longitudinal sides, each side having a plurality of uniformly spaced slots formed therein, and wherein each end of each secondary rail includes an elongated locator channel connected to the ridge and having opposing ends projecting beyond the ridge ends, and each channel end including a tab engaged within one of said primary rail support member slots.

12. The support frame of claim 11, wherein the second rail ends have a profile which matches the sides of the primary rail, and wherein the secondary rails are coplanar with and in abutting engagement with the sides of the primary rails.

13. The support frame of claim 12, herein each said primary rail support member has a generally inverted U-shaped transverse cross-section, with a longitudinally extending wood portion forming the upper end and a pair of depending longitudinally extending legs, forming the sides.

14. The support frame of claim 13, wherein:

said primary rail support member legs include an outwardly projecting, longitudinally extending, flange along the lower ends thereof, with a downwardly projecting, longitudinally extending strip, along outward edges of the flanges; and said primary rail includes a pair of parallel, spaced apart ridges formed in the upper face, each ridge spaced inwardly from the sides of the primary rail to form longitudinally extending ledges on the primary rail upper face between each ridge and its associated side of the primary rail;

said strips on the primary rail support member legs engaging said ridges to support the primary rail.

15. The support frame of claim 14, wherein said primary rail includes a longitudinally extending slot formed in the upper face thereof, extending the length of the rail, and further comprising:

an elongated insert journaled between the legs of the primary rail support member and extending the leg thereof;

said insert having a lower edge slidably engaged in the slot in the primary rail upper face, permitting horizontal slidable movement, but preventing vertical movement of the rail from the insert lower edge; and at least one fastener connecting the insert to the primary rail support member, to support the primary rail on the primary rail support member.

* * * * *